United States Patent [19]

White

[11] 4,000,732

[45] Jan. 4, 1977

[54] SOLID WICK LIGHTER

[75] Inventor: William S. White, Pasadena, Calif.

[73] Assignee: Robert H. Peterson Company, Chicago, Ill.

[22] Filed: May 27, 1975

[21] Appl. No.: 580,543

[52] U.S. Cl. ..... 126/92 R; 44/38; 126/25 B; 126/165

[51] Int. Cl.[2] ..... F24B 1/18

[58] Field of Search ..... 126/152 R, 152 B, 164, 126/165, 25 B, 96, 92 R; 44/38, 41; 431/326, 298, 325

[56] References Cited

UNITED STATES PATENTS

| | | | |
|---|---|---|---|
| 6,472 | 6/1875 | Philbrick | 44/38 |
| 417,588 | 12/1889 | Richardson | 431/326 |
| 418,316 | 12/1889 | Gathemann | 126/25 B |
| 1,059,019 | 4/1913 | Anthony | 126/25 B |
| 1,461,496 | 7/1923 | Quist | 126/25 B |
| 3,682,158 | 8/1972 | Thomas | 126/165 |
| 3,696,801 | 10/1972 | Whitehead | 126/92 R |

FOREIGN PATENTS OR APPLICATIONS

| | | | |
|---|---|---|---|
| 691,177 | 4/1940 | Germany | 44/38 |
| 735,212 | 8/1955 | United Kingdom | 126/164 |

*Primary Examiner*—William F. O'Dea
*Assistant Examiner*—Harold Joyce
*Attorney, Agent, or Firm*—William W. Haefliger

[57] ABSTRACT

A solid wick lighter is constructed for use in lighting hearth grate supported logs.

5 Claims, 6 Drawing Figures

SOLID WICK LIGHTER

BACKGROUND OF THE INVENTION

This invention relates generally to lighting apparatus employing liquid fuel, and more particularly concerns a lighter particularly useful in combination with hearth grate supported logs.

It is common practice to employ combustible gas as a source of fuel to produce hearth flames rising over and between grate supported logs. The latter may be either natural or refractory. Such gas is normally supplied via a valve and a gas pipe running to the hearth. Recently, the supply of natural gas has been reduced, so that there is need for log and other type lighters which are not dependent upon combustible gas as a fuel source; however, the means employed should not interfere with natural gas piping installed in the hearth.

SUMMARY OF THE INVENTION

It is a major object of the invention to provide a solution to the above problems. Basically, the invention contemplates the provision of a lighter which embodies a fire resistant or refractory receptacle, and a fire-resistant, solid porous wick received in the receptacle to adsorb combustible liquid poured into the receptacle, whereby controlled combustion of such liquid fuel takes place on and over the wick. In this regard, with the receptacle and wick located beneath a log supporting hearth grate, the flames produced by wick-controlled combustion of fuel rise to play over the logs with natural lighting effect, and the duration of such flame production is enhanced by the particular wick construction utilized. Further, the receptacle and wick may be integrated with an existing hearth employing a natural gas pipe, as will be seen.

More specifically, the wick may consist of a mixture of asbestos and cementitious or ceramic material; and the wick preferably has openwork construction with fuel wells and one or more flame production channels overlying the wells to enhance and distribute flame production to play over the logs in a natural manner.

These and other objects and advantages of the invention, as well as the details of an illustrative embodiment, will be more fully understood from the following description and drawings, in which:

DRAWING DESCRIPTION

DETAILED DESCRIPTION

Figure 1:
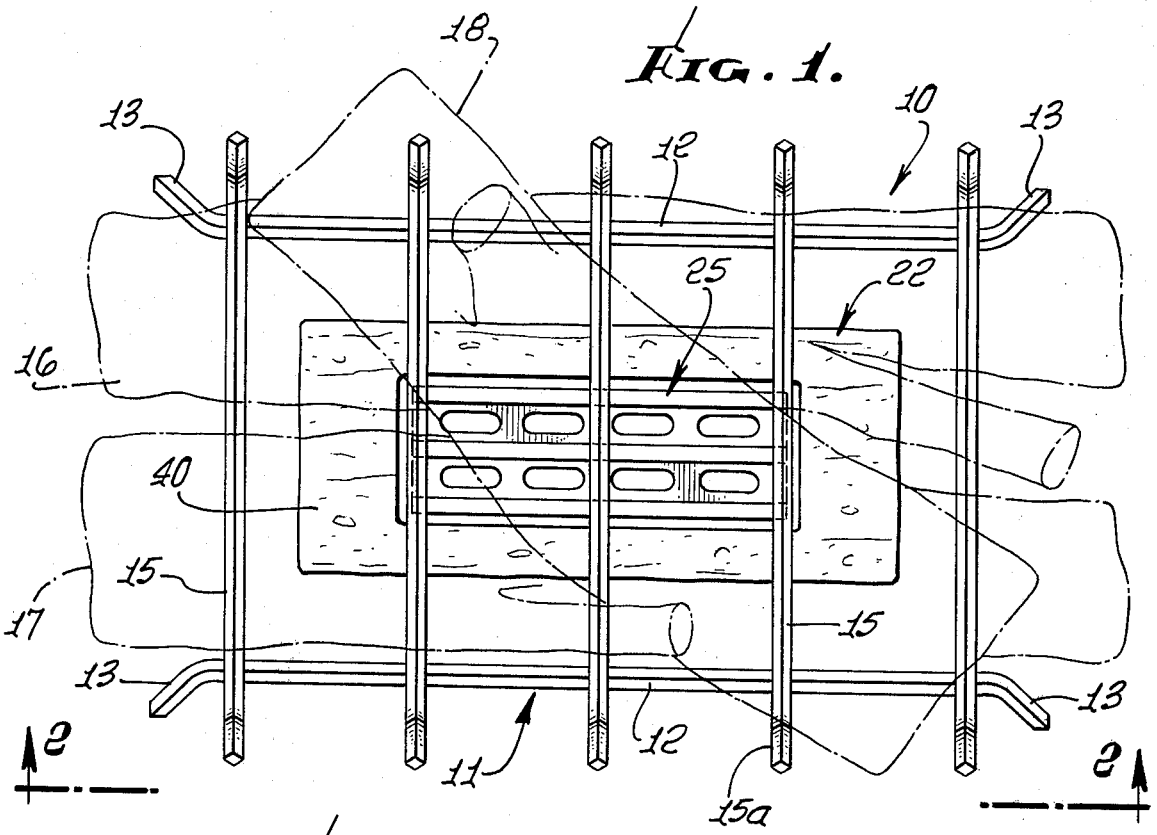
FIG. 1 is a plan view of a hearth incorporating the invention.

In the drawings, the hearth 10 is shown to include a metallic grate 11 having an openwork construction. The grate may include longitudinally horizontally extending, laterally spaced support bars 12 integral with downwardly extending legs 13 supported by hearth surface 14; in addition, the grate may include longitudinally spaced, laterally extending cross-bars 15 upon which natural or refractory logs 16–18 are supported, as in the manner best seen in FIG. 3. The ends 15*a* of the cross-bars may extend laterally and upwardly to cradle the logs.

Figure 2:
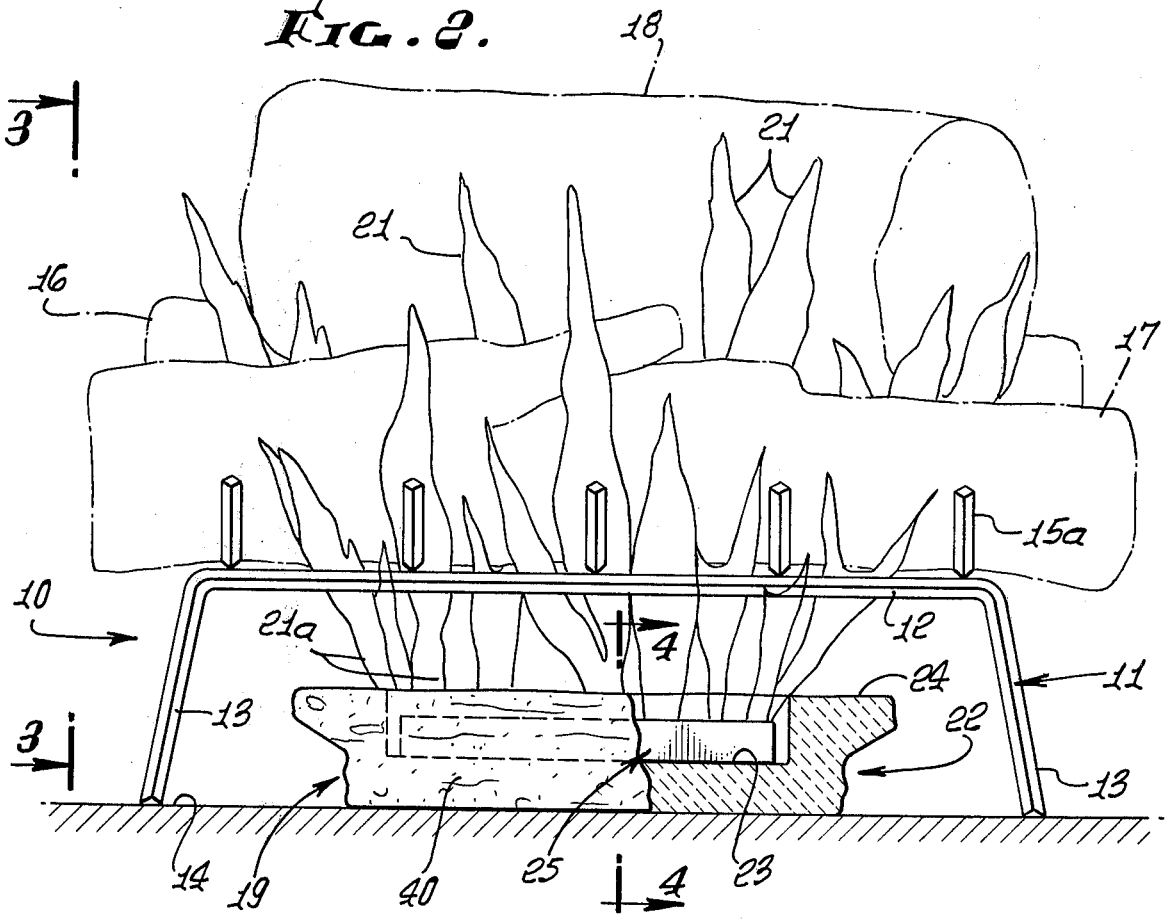
FIG. 2 is frontal elevation of the FIG. 1 hearth, and taken on lines 2—2 of FIG. 1.
Figure 3:
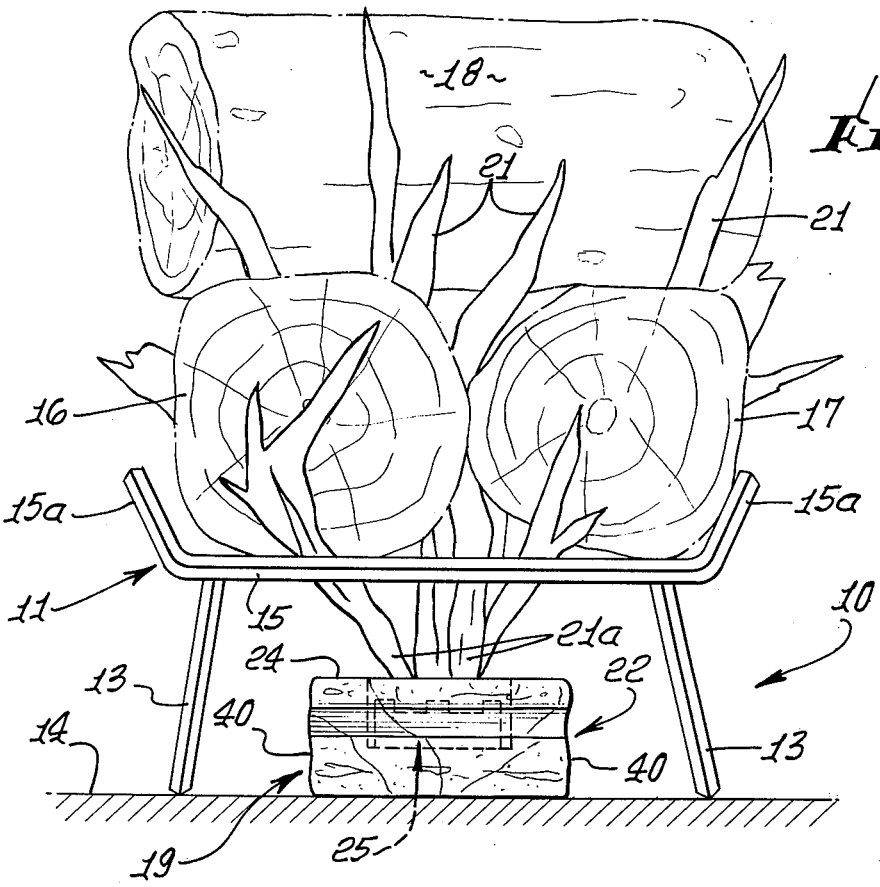
FIG. 3 is an end elevation of the FIG. 1 hearth, taken on lines 3—3 of FIG. 2.

In accordance with the invention, a lighter, as for example is illustrated at 19, is removably placed or supported on surface 14 directly below the grate in the representative manner illustrated in FIGS. 1–3. The lighter includes a fire-resistant (refractory) receptacle, together with a fire-resistant, solid porous wick received in the receptacle to adsorb combustible liquid, such as kerosene or the like, poured into the receptacle and over the wick. The construction is such that a highly effective carburetion action occurs, with blue and yellow flames produced near the wick as at 21*a*, and yellow flames rising as at 21 to flicker and play over and between the logs giving a natural log burning effect. Further, the porous, solid, openwork construction of the wick tends to control the rate of combustion so as to consume the liquid fuel to produce relatively long-lasting flaming effect.

In the particular and unusually advantageous embodiment illustrated, the receptacle 22 consist of refractory cementitious material, it is longitudinally elongated, and forms a longitudinally elongated recess 23 sunk downwardly therein from its upper surface 24.

Figure 5:
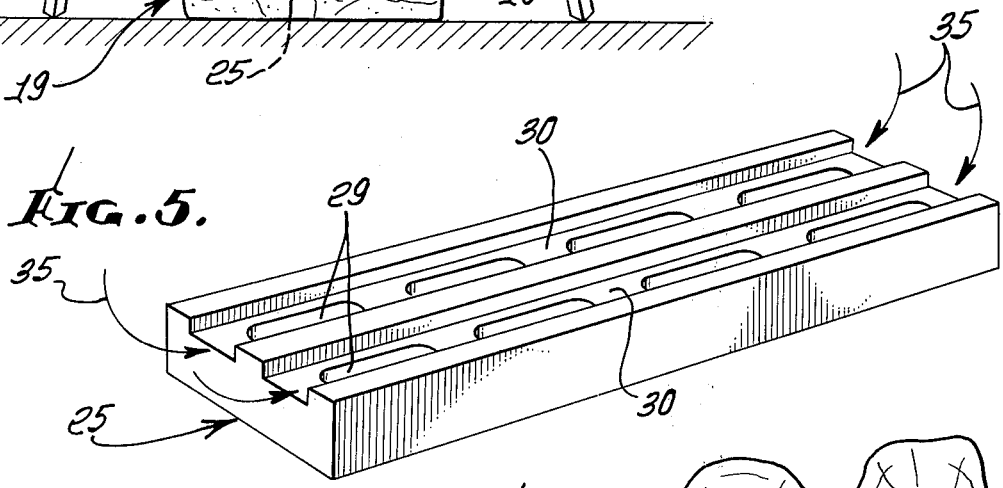
FIG. 5 is a perspective showing of a solid, porous wick as seen in section in FIG. 4.
Figure 4:
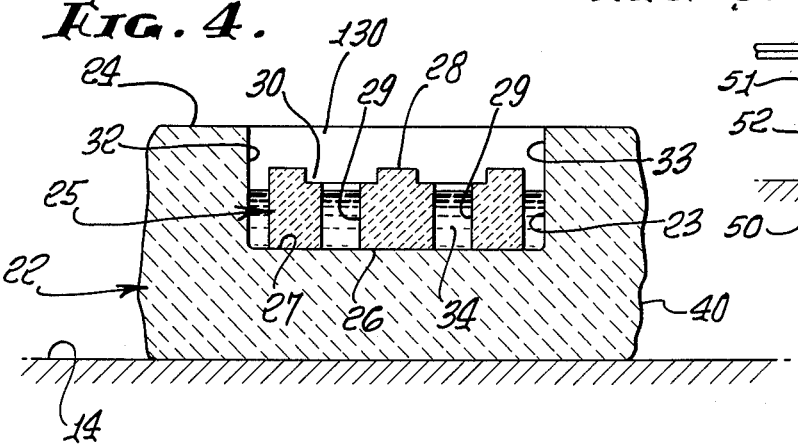
FIG. 4 is an enlarged elevation, taken in section on lines 4—4 of FIG. 2.

Wick 25 comprises a flat, plate-like body whose lateral and longitudinal dimensions are somewhat smaller than those of the essentially rectangular recess; also the wick is removably received into the recess so that its undersurface 26 seats on the flat bottom surface 27 of the recess, and its upper surface 28 is spaced below the level of the receptacle top 24. The wick has openwork construction to define a plurality of wells or openings 29 communicating between the lower interior of the receptacle recess 23 and the upper interior 130 of the receptacle, whereby combustible liquid received in the openings or wells feeds flames at a number of predetermined locations spaced over the upward facing and of the wick. Note that the wells 29 are located in two longitudinally extending, laterally spaced rows, and communicate with two longitudinally extending, laterally spaced, shallow "carburetion" channels 30. The latter receive air for combustion with the liquid fuel and locate the origins of the flames in two longitudinally extending zones, fed by fuel in the wells, for optimum flaming effect playing over the logs. Note also in FIG. 4 that the wick is closely spaced to the lateral walls 32 and 33 of the recess whereby the liquid fuel sources are distributed laterally and longitudinally over the recess for log encompassing flame production. The liquid fuel is designated at 34. FIG. 5 shows air entering the channels at their opposite ends, arrows 35 designated airflow.

The refractory wick may with unusual advantage consist essentially of an intimate mixture of asbestos and cementitious material (such as ceramic) the weight ranges being as follows:

| | weight range | preferred |
|---|---|---|
| cement | 90–70% | about 80% |
| asbestos | 10–30% | about 20% |

As previously stated, the invention enables substantial savings in natural gas commonly supplied to hearths via piping; it achieves a natural flaming effect in hearths, employing either natural or refractory logs, and cheap fuels such as kerosene may be used. Also, the refractory receptacle may have longitudinal front and rear surface texture which resembles bark of a log, as at 40, to enhance the natural appearance of the hearth. Finally, the receptacle and wick may take other forms, and be employed for lighting purposes other than log lighting.

Figure 6:
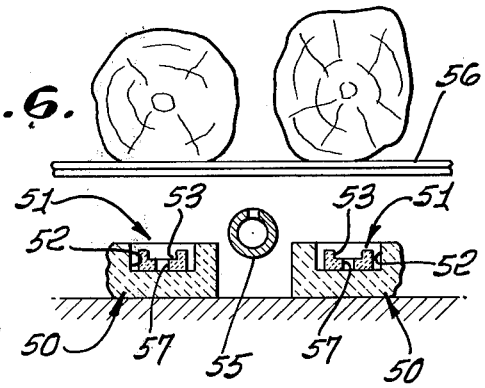
FIG. 6 is a view like FIG. 3 showing a modification.

FIG. 6 shows two narrower receptacles 50, each like receptacle 22, and wicks 51 in recesses 52 in the receptacles. The wicks are like wick 25, but narrower, and provide only one row of wells 57 and one flame channel 53. The receptacles are clustered closely adjacent a previously installed combustible gas pipe 55, at opposite sides thereof, and below grate 56. Gas supplied to pipe 55 may be shut off while the ligthers are in use.

I claim:

1. In a two-piece lighter, a. a solid, one-piece, refractory, fire-resistant receptacle, and b. a fire-resistant, one-piece solid porous wick freely downwardly received in the receptacle and seated thereon below the wick to adsorb liquid fuel poured into the receptacle and over the wick, the wick defining at least one longitudinally extending carburetion channel which has open ends and also opens upwardly, and a plurality of vertical through openings located directly below said channel and being spaced lengthwise thereof to receive said liquid fuel and to support combustion in said channel, the width of the channel exceeding the widths of said openings, c. whereby controlled combustion of said fuel takes place on and over said wick.

2. The lighter of claim 1 wherein said wick consists essentially of a mixture of asbestos and cement.

3. The lighter of claim 2 wherein said wick consists of between about 10–30% asbestos, by weight, and the remainder being cement.

4. The lighter of claim 1 wherein there are at least two of said channels which are longitudinally elongated and laterally spaced, the openings extending in longitudinal rows below said channels.

5. The lighter of claim 1 wherein the receptacle has spaced apart walls between which the wick is closely received.

* * * * *